United States Patent [19]

Jenkins

[11] 4,240,400

[45] Dec. 23, 1980

[54] SPACE HEATER

[75] Inventor: Brian Jenkins, Birmingham, England

[73] Assignee: Holt Rogers & Co., Ltd., Worcestershire, England

[21] Appl. No.: 927,158

[22] Filed: Jul. 24, 1978

[51] Int. Cl.[3] ..... F24C 3/04

[52] U.S. Cl. ..... 126/91 R; 126/85 B; 126/92 AC

[58] Field of Search ..... 126/85 B, 85 R, 69, 126/75, 76, 84, 91 R, 92 R, 92 AC, 92 B, 86

[56] References Cited

U.S. PATENT DOCUMENTS

| | | | |
|---|---|---|---|
| 1,536,646 | 5/1925 | Allington et al. | 126/91 R |
| 1,691,208 | 11/1928 | Pederson | 126/69 |
| 1,938,462 | 12/1933 | Rasanen | 126/75 |
| 3,395,693 | 8/1968 | Cowan | 126/92 R |
| 3,693,610 | 9/1972 | Ehrlichmann | 126/85 B |
| 3,703,895 | 11/1972 | Wiberg | 126/85 B |
| 3,934,572 | 1/1976 | Teague, Jr. | 126/92 B |

FOREIGN PATENT DOCUMENTS

| | | | |
|---|---|---|---|
| 1338912 | 11/1973 | United Kingdom | 126/121 |

*Primary Examiner*—Carroll B. Dority, Jr.
*Assistant Examiner*—Lee E. Barrett
*Attorney, Agent, or Firm*—Holman & Stern

[57] ABSTRACT

A room space such as a caravan is provided with a gas fired space heater having an upright casing within which is located a sealed surface combustion unit having a radiant plaque on one side of which gas is burnt. Primary and secondary air for combustion are fed from inlets below the floor of the room to appropriate sides of the plaque. The products of combustion pass upwardly to an upper part of the casing and then are deflected by a baffle sideways and downwardly to an outlet located below the plaque and below the floor of the room.

4 Claims, 4 Drawing Figures

SPACE HEATER

BACKGROUND OF THE INVENTION

Field of the Invention

This invention relates to a gas or liquid fuel fired space heater for small rooms and particularly for caravans.

In a small room space, particularly in a caravan, it is desirable to have a small compact heater which is of good thermal efficiency and which discharges all products of combustion to the outside of the room space. Preferably though not essentially, air for combustion should be drawn from outside the room space to avoid creation of draughts.

SUMMARY OF THE INVENTION

The object of the invention is to provide a new or improved space heater for use in small room spaces.

One aspect of the invention is a fluid fuel fired space heater comprising a radiant heater having an upright casing, a sealed surface combustion burner unit, mounted within the casing, and inlet for air for combustion at the burner at the lower part of the casing, an outlet for gases heated at the burner at the upper part of the casing, a baffle located above said outlet to deflect the hot gases in a sideways and downwards direction, a duct extending from a position adjacent said baffle downwardly to a position below the level of combustion at the burner through which the hot gases pass in a downwards direction.

Another aspect of the invention is a room space having therein a fluid fuel fired space heater comprising a radiant heater having an upright casing, a sealed surface combustion burner unit, mounted in the casting, an inlet for air for combustion at the burner at the lower part of the casing, an outlet for gases heated at the burner at the upper part of the casing, a baffle located above said outlet to deflect the hot gases in a sideways and downwards direction, a duct extending from a position adjacent said baffle downwardly to an exhaust located outside the room space and below the level of combustion at the burner.

Preferably the hot gases are deflected sideways in two directions which are directly opposed so that they travel down through a pair of ducts placed one adjacent each of the two sides of the upright casing and each duct is constructed with sufficient mass of metal to provide a large area of surface to be contacted by the gases to ensure that enough heat is extracted from the gases to cause them to be cooled and thus create a downflow of exhaust gases to be discharged outside the room space.

In a caravan, for example, the heater is conveniently mounted on a floor with the ducts extending to floor level so that exhaust gases are discharged through a suitable opening or openings in the floor. Preferably also primary air for the radiant heater and secondary air for combustion enters through an opening or openings through the floor.

BRIEF DESCRIPTION OF THE DRAWINGS

The invention is illustrated by way of example in the accompanying diagrammatic drawings which show one form of heater according to the invention and suitable for use in a caravan.

In the drawings.

DESCRIPTION OF THE PREFERRED EMBODIMENTS

Figure 1:
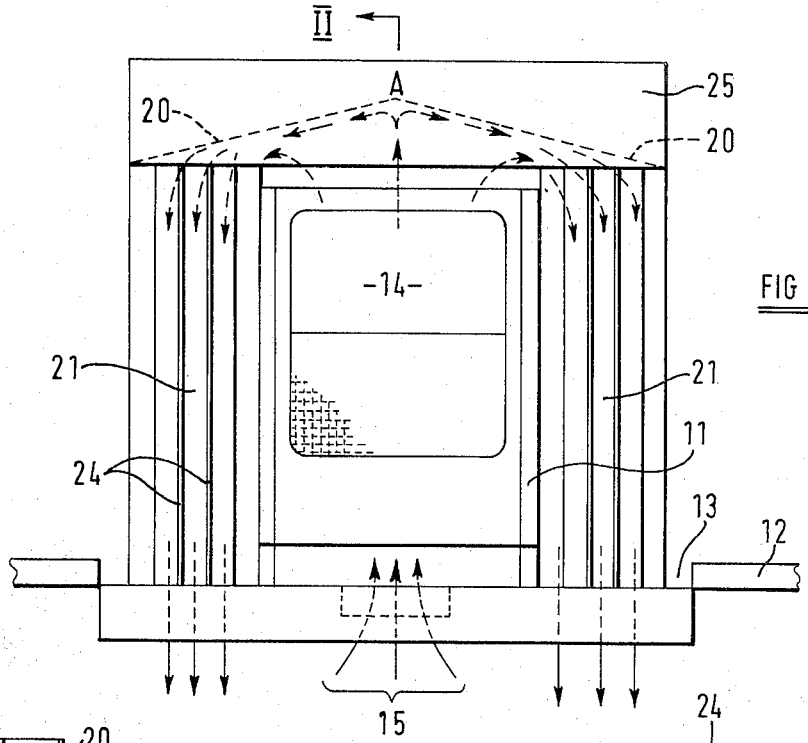
FIG. 1 is a front elevation
Figure 2:
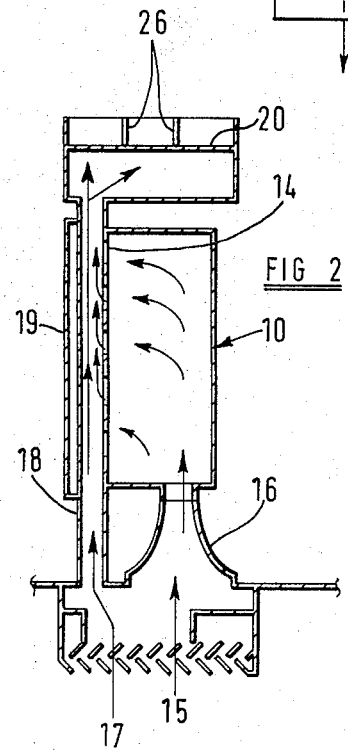
FIG. 2 is a cross-sectional view along line II—II

The external casing which would be provided for the heater is not shown in the drawings, and details of the burner unit and controls are also not shown.

A radiant heater having a sealed, surface combustion burner unit and of generally known form is indicated generally at 10 in the drawings as mounted in an upright inner casing 11 and this, with the associated parts of the heater, is constructed so as to be able to be mounted in an opening 13 cut in the floor 12 of a caravan. The plaque of the radiant heater is indicated at 14 and this may comprise one, two or more separate plaques according to the size of the heater desired. Primary air for the burner unit of the radiant heater enters through the opening in the floor of the caravan as indicated by the arrow 15 and passes through a funnel-shaped member 16 into the sealed burner unit.

Secondary air for combustion enters from below the floor 12 as indicated by arrow 17, and passes upwardly across the face of the radiant plaque or plaques 14 and through the space between the front face of the radiant heater and the casing part 18 which is preferably provided with a ceramic glass plate 19 to act as a front panel and also provide the heater with a visual effect.

The top wall of the casing, indicated at 20, has two sloping sides rising to an apex indicated by the letter A which is immediately above the centre line of the radiant heater and the parts 20 act as a baffle to deflect the hot gases sideways in two opposite directions as indicated by the arrows in FIG. 1.

Figure 3:
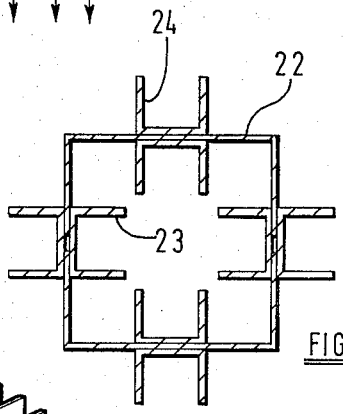
FIG. 3 is a horizontal cross section through one of the ducts for the exhaust gases
Figure 4:
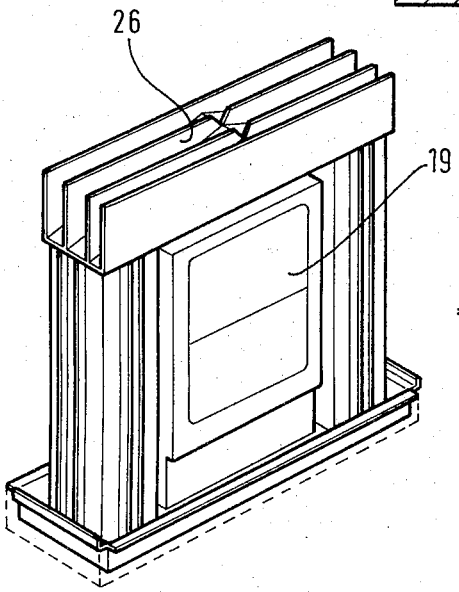
FIG. 4 is a perspective view.

The position indicated by apex A becomes a "hot spot" and gases which are forced sideways come to the upper ends of the two downwardly extending ducts, generally indicated at 21 in FIG. 1, where they encounter a substantial mass of metal which has an immediate cooling effect. The gases are therefore cooled and passed downwardly through the duct to be discharged through outlets in the opening 13. A suitable construction for one of the ducts 21 is illustrated in the cross-section in FIG. 3 comprising a casing 22 with internal and external fins 23 and 24 respectively. The fins 23 and 24 are conveniently formed by securing (such as by welding or brazing) channel-section members to the interior and exterior respectively of a hollow rectangular cross-section casing 22. It will be appreciated that other forms of construction may be adopted for these ducts 21, depending upon the size and cross-section of the ducts, the object being to provide a large mass of metal and a large surface area for cooling of the exhaust gases without impeding the downward flow of the gases to an outlet below the level of combustion at the burner.

The space 25 above the baffle 20 is provided with fins 26 which extract heat from the hot spot A to aid cooling of the gases and the heat dispelled by the fins 26 may escape through a grill in the front of the external casing.

I claim:

1. A room space having a floor, a gas fired space heater located in said room space above said floor, said heater comprising an upright casing having a lower part and an upper part, a sealed surface combustion burner unit located in said lower part and having a radiant plaque on one side of which combustible gas is burnt, means to feed air to the other side of said plaque, from an inlet below said floor, to provide primary air for burning of said gas, means to feed secondary air, from an inlet below said floor to the interior of said lower part on said one side of said plaque for burning of said gas, an outlet for the products of combustion at said upper part, a baffle located above said outlet to deflect said products of combustion sideways and downwards, a duct extending from a position adjacent said baffle downwardly to an exhaust located below said radiant plaque and beneath said floor.

2. A room space according to claim 1 in which the baffle defines a pair of guides to deflect the hot gas sideways in two directions, which are directly opposed and there being a pair of ducts placed one adjacent each of the two sides of the upright casing, each duct being constructed with sufficient mass of metal to provide a large area of surface to be contacted by the gases.

3. A room space according to claim 2 wherein each duct comprises a casing having internal and external fins extending longitudinally thereof.

4. A room space according to claim 3 wherein the casing of each duct is of rectangular cross-section and the fins are provided by securing channel-section members to the interior and exterior of the casing.

* * * * *